US010393467B1

(12) United States Patent
Ding et al.

(10) Patent No.: US 10,393,467 B1
(45) Date of Patent: Aug. 27, 2019

(54) FIREARM DUST COVER

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 16/247,113

(22) Filed: Jan. 14, 2019

(51) Int. Cl.
*F41A 35/04* (2006.01)
*F41A 35/02* (2006.01)

(52) U.S. Cl.
CPC ..... *F41A 35/02* (2013.01)

(58) Field of Classification Search
CPC ..... F41A 35/02
See application file for complete search history.

(56) References Cited

U.S. PATENT DOCUMENTS 2,940,201 A * 6/1960 Reed ..... F41A 35/02 42/16
3,369,316 A * 2/1968 Miller ..... F41C 23/04 42/72
9,188,405 B2 * 11/2015 Hawley ..... F41A 35/02
9,612,075 B1 * 4/2017 Stephens, IV ..... F41A 35/02
9,958,229 B1 5/2018 Meier
9,970,728 B1 * 5/2018 Huang ..... F41A 35/02
2005/0016051 A1 * 1/2005 Fischbach ..... F41A 15/00 42/96

OTHER PUBLICATIONS https://www.strikeindustries.com/shop/products/ar/upper-parts/ar-enhanced-ultimate-dust-cover-223.html downloaded on Dec. 14, 2018.

* cited by examiner

*Primary Examiner* — Gabriel J. Klein
(74) *Attorney, Agent, or Firm* — Warner Norcross + Judd LLP

(57) ABSTRACT

A dust cover for a firearm includes a panel, a hinge pin and a spring disposed around the hinge pin. The spring engages the hinge pin so that the spring is non-slidable relative to the hinge pin. The spring includes a first prong that engages the panel to bias the panel away from the ejection port. The spring includes a second prong, distal from the first prong, that is manually engageable by a user to slide the hinge pin within a panel passageway while the spring remains non-slidable relative to the hinge pin so as to remove a part of the hinge pin from a hole defined by the firearm and thereby free the dust cover for removal from the firearm. A related method of use is provided.

20 Claims, 7 Drawing Sheets

FIREARM DUST COVER

BACKGROUND OF THE INVENTION

The present invention relates to firearms, and more particularly to a dust cover that covers an ejection port of a firearm.

Many types of firearms include a dust cover to reduce the likelihood of dust, dirt, and debris from entering the firing mechanism of the firearm through an ejection port. Many dust covers are movable, such as dust covers for the AR-15 rifle. These movable dust covers automatically open upon firing of the rifle, but must be manually closed after firing to close off the ejection port. Dust covers for firearms typically include a spring-loaded, hinged door arrangement, which is latched closed when the firearm is not in use, but which spring open when a bolt of the firearm retracts and a spent casing is ejected through the ejection port. The dust cover typically does not move with the moving parts of the firearm, but simply opens and remains open until manually closed.

Dust covers often break due to component failure. For example, a spring biases the dust cover toward the ejection port. The spring undergoes significant stress during opening, and can fail after repeated openings of the cover. When the spring fails, the dust cover pivots away from the ejection port and dangles from the side of the firearm.

Many consumers desire to replace stock dust covers that come with the firearm with a more aesthetically pleasing dust cover, or a dust cover having a particular slogan or image to reflect the user's personal interests. Unfortunately, removal and replacement of a standard dust cover is difficult. Typically, the removal requires either handguard or delta ring to be removed first. Then, a user must use a punch or pliers (or some other tool) to punch out or pull out the hinge past a battery projection on the firearm. Sometimes, if the hinge is uncooperative, removal of the dust cover also requires breakdown of other parts of the firearm, further complicating the process. The requirement of a tool to remove the dust cover is burdensome, particularly where a dust cover replacement is performed in the field. The small parts of present dust covers also make the removal process frustrating and tedious.

Accordingly, there remains room for improvement in the field of dust covers for firearms, and in particular the mechanisms that attach the dust covers to a firearm.

SUMMARY OF THE INVENTION

A dust cover for a firearm includes a panel, a hinge pin and a spring that engages the hinge pin so that the spring is non-slidable relative to the hinge pin while the hinge pin is moved to remove the dust cover from the firearm.

In one embodiment, the spring can include a first prong that engages the panel to bias the panel away from an ejection port of the firearm. The spring can include a second prong distal from the first prong. The second prong can be manually engageable by a user to slide the hinge pin within a panel passageway while the spring remains non-slidable relative to the hinge pin so as to remove a part of the hinge pin from a hole defined by the firearm and thereby free the dust cover for removal from the firearm.

In another embodiment, the dust cover can include a secondary pin joined with the panel. The hinge pin can be separated from the secondary pin by a gap within the passageway of the panel. The gap can decrease when the hinge pin slides within the passageway, for example, such that the hinge pin moves toward the secondary pin.

In still another embodiment, the secondary pin can be non-rotatable or fixed and/or immovable relative to the passageway and panel, but the hinge pin can be rotatable relative to the passageway and panel.

In yet another embodiment, the spring can be a torsion spring coiled around the hinge pin. The torsion spring can include a first coil end and a second coil end, and a transverse spring portion adjacent the first coil end. The transverse spring portion can be disposed in the groove of the hinge pin so that the torsion spring is non-slidable relative to the hinge pin adjacent the transverse spring portion and/or between the coil ends.

In even another embodiment, the first prong of the spring can extend away from the first coil end. The first prong can be configured to bias the panel away from the ejection port when a casing is ejected through the ejection port so that the panel rotates about the passageway axis.

In a further embodiment, the hinge pin can define a groove extending around the hinge pin. This groove can be an annular groove extending around a circumference of the hinge pin. A transverse portion of the spring can extend tangentially through a portion of the annular groove so as to render the spring generally immovable relative to the hinge pin due to the interference of the transverse portion with the material adjacent the groove.

In still a further embodiment, the first prong can extend away from spring a greater distance than the second prong extends away from the spring. The first prong can extend away from the spring at least ¼".

In yet a further embodiment, the first prong can be configured to bend or flex toward the hinge pin when the hinge pin slides within the passageway while the spring remains generally non-slidable relative to the hinge pin.

In even a further embodiment, the panel can include a protrusion on an interior surface of the panel. The first prong can engage the protrusion when the hinge pin slides within the passageway so that the spring portion bends toward the hinge pin as the hinge pin is removed from a hole defined by the firearm on a first side of the ejection port.

In another further embodiment, the hinge pin can engage the first hole of the firearm and the secondary pin can engage a second hole of the firearm. The first hole and the second hole can lay on a common axis. The hinge pin can slide relative to the first hole when the first prong of the spring is manually moved, but the secondary pin can remain stationary and/or nonsliding relative to the second hole while the hinge pin slides.

In still another, further embodiment, a method is provided including providing the dust cover, and engaging the second prong to slide the hinge pin within the passageway while the spring remains generally non-slidable relative to the hinge pin adjacent the spring portion so as to remove a part of the hinge pin from a first hole defined by the firearm and thereby free the hinge pin and panel for removal from the firearm.

The current embodiments of the dust cover and related method provide benefits related to firearm dust covers that previously have been unachievable. For example, with the present dust cover, a user can quickly and efficiently remove and/or replace the dust cover without the use of tools. The dust cover can have all its components joined with one another as a single assembly, so when it is removed, no small parts are free to be potentially lost. Where the dust cover includes a spring portion trapped in a groove of the hinge pin, the spring remains generally fixed along an axis of the hinge pin, so a prong of the hinge pin can engage the same part of the panel to bias that panel consistently. Generally, the spring is impaired or prevented from shifting along its axis when the dust cover is installed. The construction also can facilitate installation and removal of the dust cover without removal of a handguard associated with the firearm.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
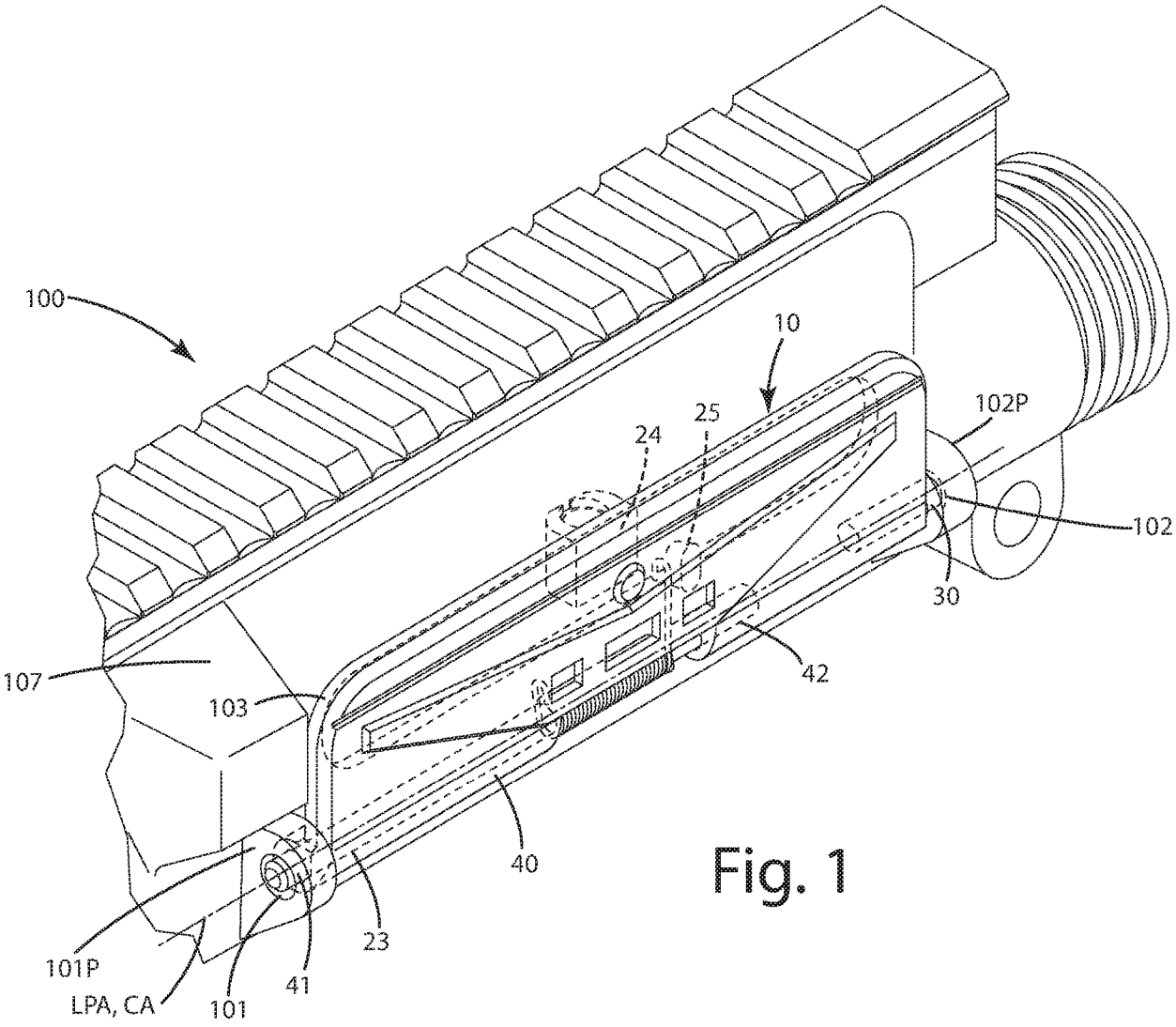
FIG. 1 is a perspective view of the dust cover of a current embodiment in a closed mode covering an ejection port of a firearm.

A current embodiment of a dust cover for a firearm is illustrated in FIGS. 1-7 and generally designated 10. The dust cover is configured to cover an ejection port 103 of a firearm 100. The firearm 100 illustrated is in the form of an AR-15, but of course can be any other type of firearm having a dust cover. The firearm to can include a stock configured to shoulder against a user, a barrel, a handguard, an upper receiver 107 and a lower receiver 108, which is configured to receive a removable magazine.

Figure 2:
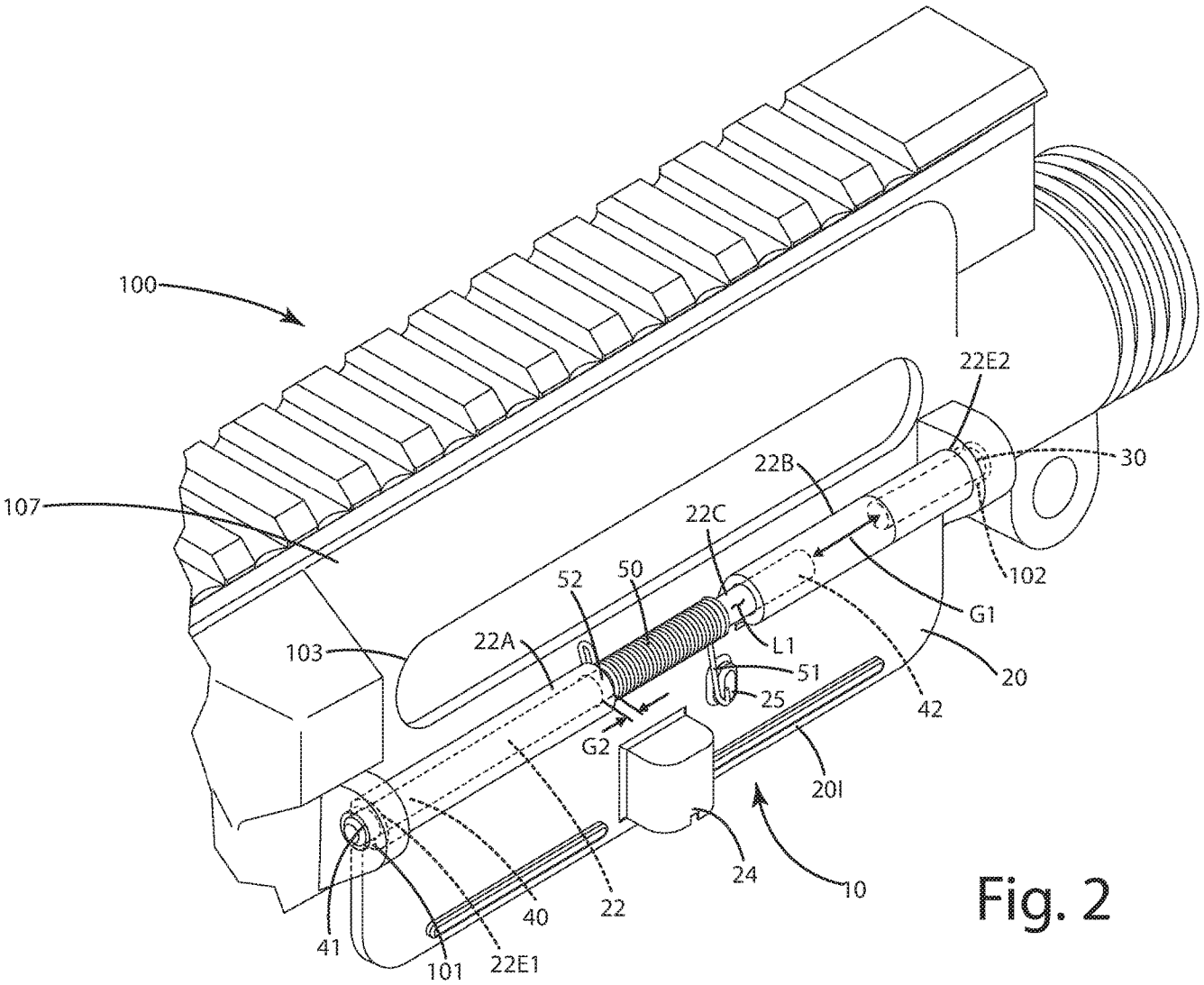
FIG. 2 is a perspective view of the dust cover in an open mode not covering the ejection port of the firearm.

With reference to FIG. 1, the dust cover 10 is in a first or closed position to generally cover the ejection port 103 and prevent dust, dirt and debris from entering the same. With further reference to FIG. 2, the dust cover 10 is in a second or open position such that the dust covered 10 has been pivoted away from the firearm, while remaining attached via the secondary pin 30 and hinge pin 40 and as described below. In this manner, the ejection port 103 is open so that spent casings can be ejected through that opening from the firing mechanism of the firearm 100.

The firearm can include a first hole 101 and a second hole 102. These holes can be cylindrical or rounded in shape. These holes can be defined in minor projections 101P and 102P extending away from the upper 107 of the firearm 100. These holes can be aligned along a common axis CA. The hinge pin 40 as described below also can have a longitudinal hinge pin axis LPA that is coincident with this common axis CA when the hinge pin 40 is installed in a respective hole. The hinge pin 40, as well as a secondary pin 30, can be configured to freely rotate within the respective first hole 101 and the second hole 102 when the dust cover 10 transitions from the closed mode shown in FIG. 1 to the open mode shown in FIG. 2 or vice versa.

The dust cover 10 can include a panel 20 that is sized and configured to close the ejection port 103. The panel 20 can be constructed from a metal, a polymer, a composite, or any other material. The panel 20 can be formed from a stamping, injection molding, or any other suitable manufacturing process. The panel can define a passageway 22 which can be in the form of a tube that is integral with or formed as a part of the panel 20. This tube can be a closed, bounded tube or can be a channel or a partially closed or open tube. The tube can include a first tube portion 22A and a second tube portion 22B. The first portion 22A and the second portion 22B can be separated by an opening or gap 22C.

The hinge pin 40 can extend through the first portion 22A of the tube or passageway, through the gap or opening 22C into at least part of the second portion 22B. The passageway 22 also can define or include a first end 22E1 and a second end 22E2. The hinge pin 40 can include a first end 41 and a second end 42. The first end 41 can project outwardly and away from the first and 22E1 of the passageway 22 and generally from the first portion 22A of the tube. The second end 42 can be disposed in the second tube portion 22B.

As shown in FIGS. 1-2, the panel can include a protrusion 24 that extends inward from an interior surface 20I of the panel 20. This protrusion 24 can be configured to engage a portion of the firing mechanism of the firearm, such as a bolt carrier group upon firing of the firearm 100, which in turn causes the panel to be automatically opened under the bias of the spring 50. The panel can include another protrusion 25 that is distal from the protrusion 24. This protrusion 25 can also be disposed of interior surface 20I of the panel. As described below, this protrusion 25 can engage a spring portion 51 of the spring which also can be in the form of a first prong of a spring. The protrusion can project outwardly from the interior surface 20I a preselected distance depending on the first prong 51 and its interaction with that protrusion 25. The protrusion 25 can be aligned with the opening 22C in the passageway so that it overlaps a portion of that opening 22C.

With further reference to FIGS. 1-2 and 6-7, the hinge pin 40 as shown can be cylindrical or otherwise can have a circular or rounded cross-section. The hinge pin 40 can be disposed slidably and rotatably in the passageway 22 of the panel 20. The hinge pin 40 can define a groove 45 between the first end 41 and the second end 42. This groove optionally can be an annular groove, but of course can take the form of a hole, a recess, a slot or even a protrusion or projection extending away from the surface of the hinge pin that is sized to accommodate a portion 55 of the spring. Upon such engagement, the hinge pin 40 and the spring 50 optionally can be rotatable relative to one another, but via the interaction of the spring portion 55 in the groove 45, the spring 50 is generally not slidable relative to the hinge pin, at least at the portion 55 where it engages the groove. Of course, another portion of the spring near the second prong 52 may slide slightly during engagement by a user relative to the hinge pin.

The spring portion 55 can be bent in angle A1 relative to a terminal portion 56P of the first coil end 56. From there, the spring portion 55 optionally can extend linearly away from the coils 50C of the spring 50. The angle A1 can be at least 20° relative to a tangent line taken at the terminal portion 56P. In other cases, the angle A1 can be optionally at least 30°, at least 45°, at least 60°, between 20° and 90°, inclusive, between 45° and 80°, inclusive or between 45° and 90°, inclusive. The first coil end 56 can be distal from the second coil and 57. Generally, the first prong 51 can be joined with spring portion 55, which also can be referred to herein as a transverse spring portion. In some cases, the first prong 51 can form an extension of the spring portion 55.

Figure 6:
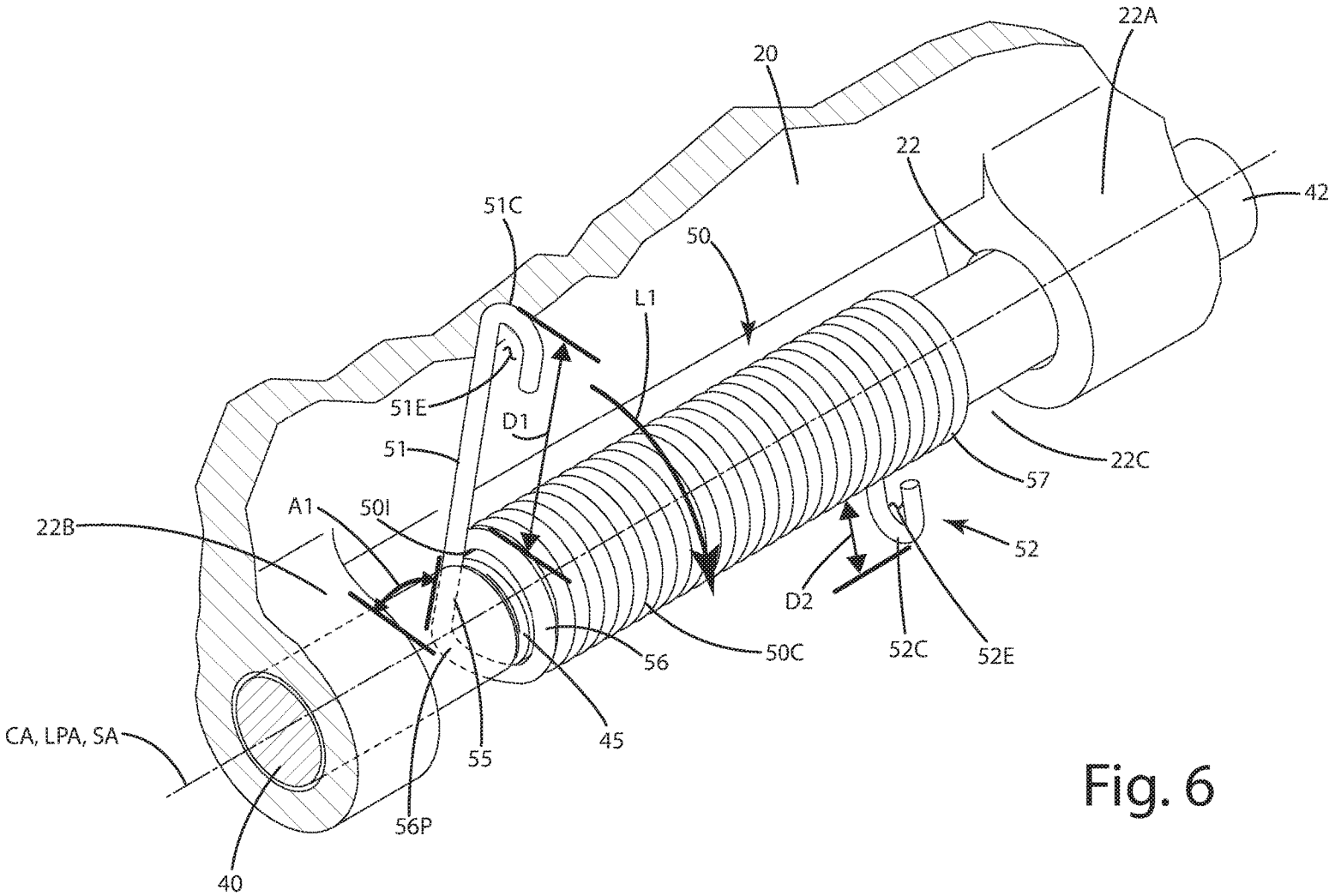
FIG. 6 is a perspective view of the spring and hinge pin, with a transverse portion of the spring engaging a groove defined by the hinge pin to prevent the hinge pin and spring from sliding relative to one another, but enabling them to rotate relative to one another.
Figure 7:
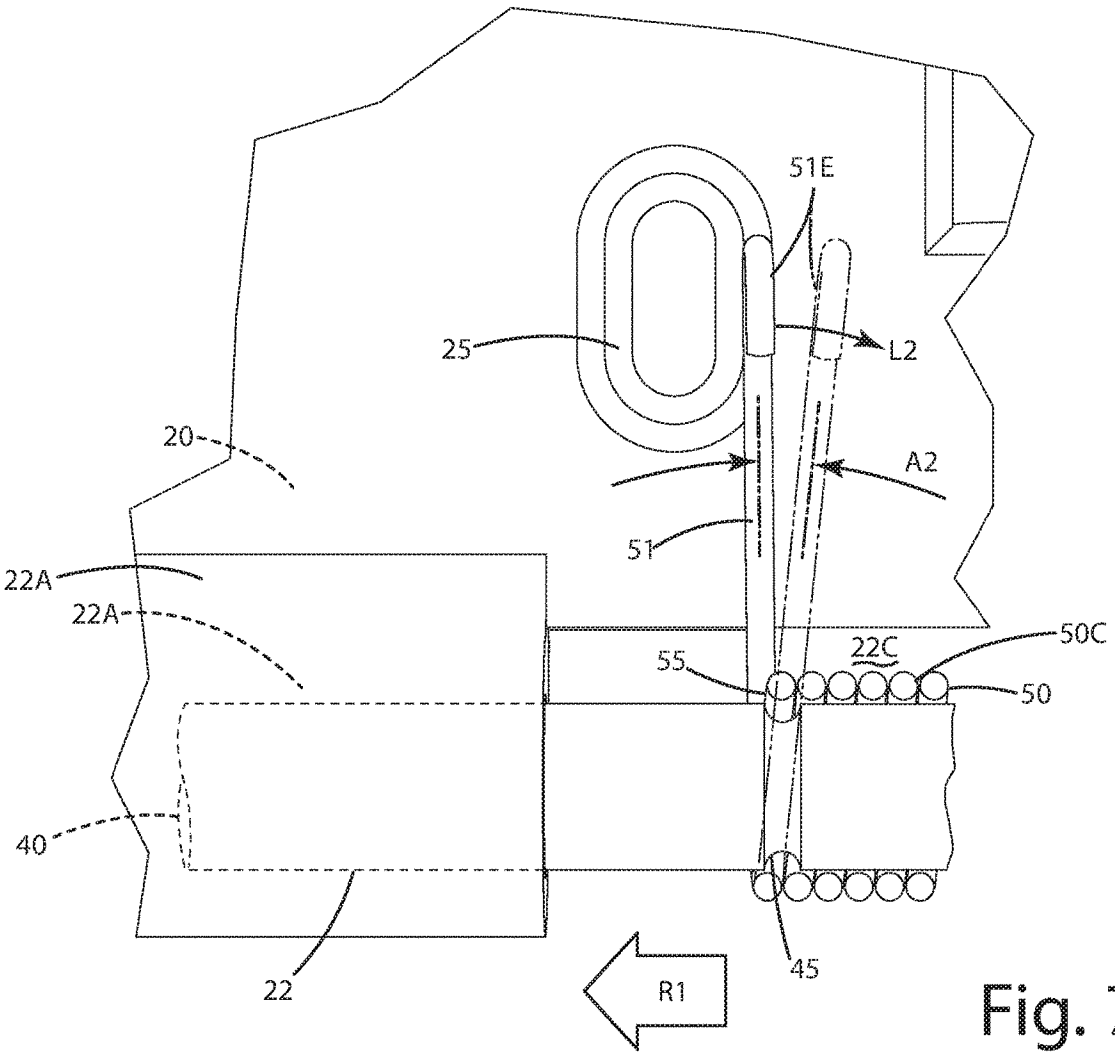
FIG. 7 is a side view of the transverse portion of the spring in the groove of the hinge pin.

The spring 50 is shown in the form of a torsion spring with a plurality of coils 50C that can form a cylindrical cavity 50I. The spring 50 can include a longitudinal spring axis SA. As shown in FIG. 6, the spring axis SA can be coincident with the common access CA and the longitudinal hinge pin axis LPA. The cylindrical cavity 50I optionally can be interrupted near the first coil end 56 by the spring portion 55. The spring portion 55 can be substantially linear as shown, but also can be curved to a lesser or greater degree than the remaining coils 50C. This spring portion 55 can be located closer to the spring axis SA of the spring 50 than the other remaining coils 50C of the spring.

As also shown in FIG. 6, the spring portion 55 can interface with the hinge pin 40 in a particular manner. As shown, the spring portion 55 can extend tangentially through portion of the groove 45. The groove 45 can be an annular groove extending around the circumference of the hinge pin 40. The spring portion 55 can fit within the groove and can be trapped therein. When it is trapped in the groove, the remainder of the spring 50, that is, the coils 50C, the first prong 51 and the second prong 52 generally can be not slidable relative to the hinge pin 40. The spring portion 55 can optionally be slidable within the groove 45 around the hinge pin axis LPA or spring axis SA, even though the spring 50 itself is not slidable linearly along the hinge pin 40. For example, the spring portion 55 can slide or move within the groove 45 such that the first prong 51, second prong 52 and coils 50C can rotate about the spring axis SA when the dust cover is opened from the closed mode in FIG. 1 to the open mode shown in FIG. 2. The spring 50 stores energy within itself when the dust cover 10 is in the closed position, so that the spring can automatically open the dust cover when actuated by the firing mechanism of the firearm 100. The spring 50 and its components can coil and uncoil about the hinge pin 40, optionally due to the free movement of the spring portion 55 within the groove 45.

Optionally, although the spring 50 is shown as being slidably restrained along the longitudinal pin axis LPA by interaction of the spring portion 55 in the groove 45, the spring can be altered to interact with the hinge pin in other ways. For example, there can be a projection from the pin and a portion of the spring can wrap at least partially around a projection to prevent sliding movement relative to the pin. Other connections can be made between the pin and spring, for example, via welds, fasteners and adhesives.

As mentioned above, the first prong 51 can extend away from the spring portion 55 and generally away from the coils 50C for a first distance D1 measured at the first coil end 56. At the second coil end 57, the second prong 52 can extend away from the second coil by a distance D2. The distance D1 can be greater than distance D2. Optionally, the distance D1 can be at least ⅛", at least ¼", at least ½". Further optionally, the distance D2 can be less than ¼", optionally between ⅛" and ¼", further optionally less than ½". The first 51 and second 52 prongs can be configured to include curved portions 51C and 52C respectively. For example, the first prong 51 can be bent to form into the first curved portion 51C. The second prong 52E can be bent to form the second curved portion 52C.

Figure 3:
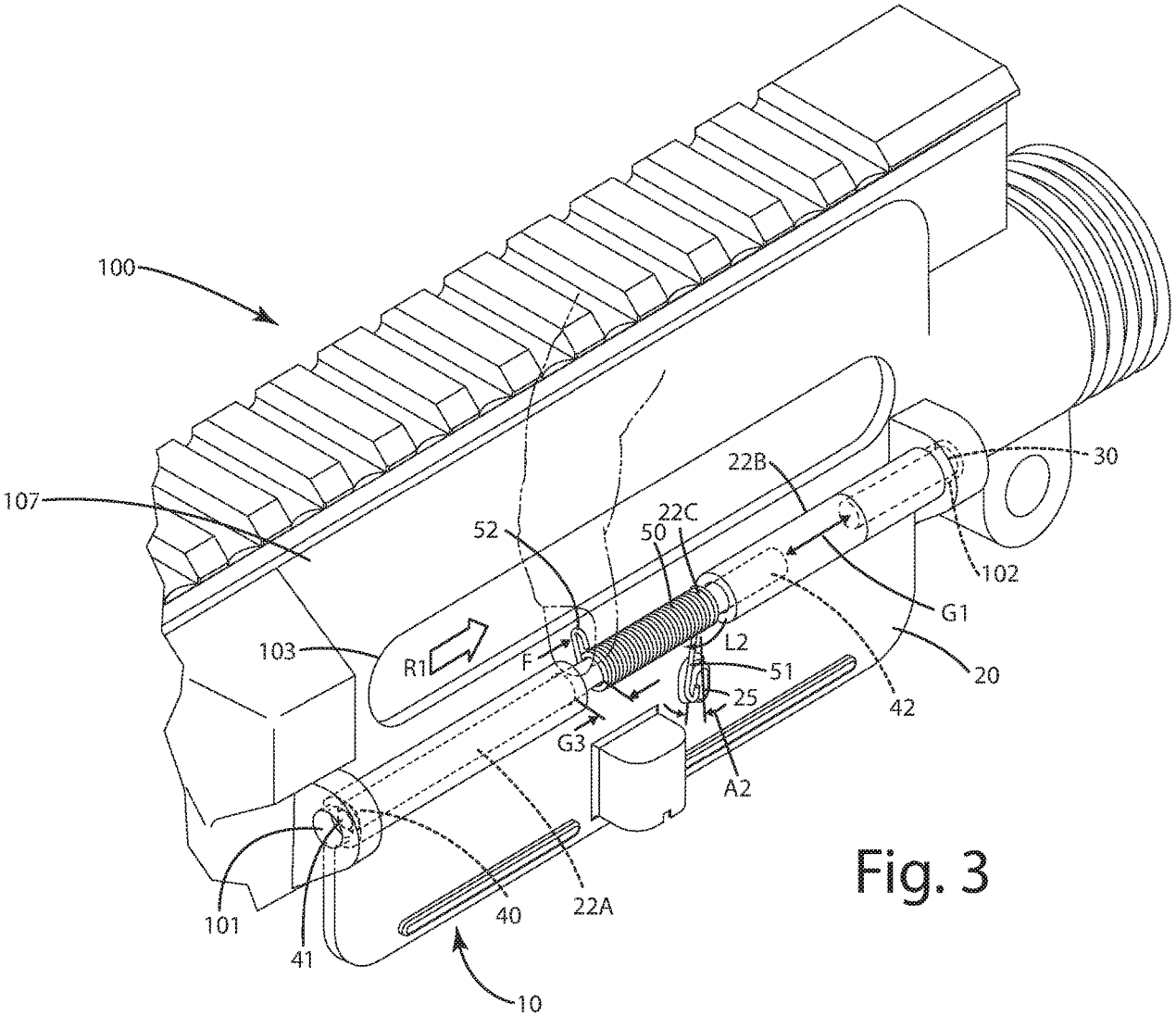
FIG. 3 is a perspective view of the dust cover with a user manually engaging a portion of the spring to retract a hinge pin from a hole in the firearm so that the hinge pin is free relative to the hole.

The first prong 51 can be configured to move in multiple directions. For example, the first prong 51 can be configured to rotate outward in direction L1 when the spring 50 automatically opens the panel 20 relative to the ejection port 103, as shown in FIGS. 2 and 6. In addition, the first prong 51 can be configured to move in direction L2 as shown in FIG. 3 when the hinge pin 40 moves in direction R1 along the common axis CA, spring axis SA and longitudinal pin axis LPA. When the first prong 51 moves in direction L2, it can generally engage the protrusion 25. When it engages the protrusion 25, it can bend or flex in that direction L2. The angle of the first prong 51 thus can change from being generally perpendicular to the spring axis SA to a second angle A2 as shown in FIG. 3. This second angle A2 optionally can be about 1° to about 30°, inclusive; between about 5° and about 25°, inclusive; or between 1° and 45°, inclusive. During this bending, however, the torsion spring 50 and its coil 50C can positionally fixed and not slidable relative to the hinge pin 40, and in particular the pin longitudinal axis LPA. Again, this can be due to the spring portion 55 interlocking within the groove 45 of the hinge pin 40 as described below.

With reference to FIG. 2, the spring 50 is coiled around the hinge pin 40 and configured to store energy therein. With reference to FIG. 2, the first prong 51 engages the panel 20 adjacent the projection 25. The second prong 52 engages the firearm, in particular, and the portion or surface adjacent the opening 103 of the ejection port 103. The spring 50 stores energy in it so that the first prong 51 is biased to rotate about the spring axis SA while the second prong 52 engages the firearm surface. It is this stored energy that biases and opens the panel 20 relative to the ejection port 103 in use.

The dust cover 10 optionally can include a secondary pin 30 as mentioned above. This secondary pin 30 can extend beyond the panel 20 and beyond the end 22E2 of the passageway 22. A portion of the secondary pin 30 is registered in and is rotatable relative to the second hole 102 defined by the firearm. The secondary pin can be generally immovably and fixedly joined with the panel, but is configured to rotatably mount in the second hole. The secondary pin optionally can be non-rotatable or fixed relative to the passageway and the panel, while the hinge pin can remain rotatable relative to the passageway and the panel.

The secondary pin 30 can be an actual pin or a part that is joined with or otherwise inserted into the passageway 22. In other cases, the secondary pin 30 can be a projection that is integral with and molded to the remainder of the panel 20. The secondary pin 30 can be configured so that the hinge pin, and in particular the second end 42 of the hinge pin is separated from the secondary pin 30 by a gap G1. Where the secondary pin and the hinge pin are disposed in the passageway, this gap G1 can be located within the passageway. This gap G1 as described below, can be changed or altered in length or size when the hinge pin 40 moves in the passageway, generally toward the secondary pin 30 along the common axis CA or longitudinal pin axis LPA. In particular, this gap G1 can decrease when the hinge pin 40 slides in the passageway 22 when a user is manipulating the spring 50 to remove the dust cover 10 from the firearm as described below. In addition, the second prong 52 is configured to move away from the first tube portion 22A and toward the second tube portion 22B when a user exerts a force μl on the second prong 52 to slide the hinge pin 40 in the passageway and tubes as described below.

A method of removing and replacing or otherwise using a dust cover 10 of the current embodiment will now be described with reference to FIGS. 1-7. As shown in FIG. 1, the dust cover 10 is in a closed position. The dust cover can be held closed by a closure projection 24 on the panel 20 of the dust cover 10. When the firing mechanism and bolt carrier group of the firearm 10 moves rearward, it engages the closure 24 and releases the dust cover panel from the closed position in FIG. 1 to the open position in FIG. 2. During this, the torsion spring 50 utilizes energy stored in it to push the panel 22 to the position shown in FIG. 2. In particular, the coils 50C in the spring 50 can be wound slightly so that the first prong 51 moves in direction L1 and pushes against the panel 20, while the second prong 52 engages the surfaces of the firearm 100 so the spring does not spin relative to the hinge pin 40. The hinge pin can remain engaged with the first hole 101 at its first end 41. The panel 20 and passageway 22 can rotate about the common axis CA or longitudinal pin axis LPA during the opening of the dust cover 10 to expose the ejection port 1032 or generally open the ejection port. The secondary pin 30 also can engage the second hole 102 of the firearm and can rotate relative to it as the dust cover 10 opens. In the open configuration, shown in FIG. 2, the hinge pin 40 can be separated from the secondary pin 30 by the gap G1. The second prong 52 can be separated from the first tube portion 22A by a gap G2.

To remove the dust cover 10 from the firearm 100 and away from the ejection port 103, a user can engage the second prong 52 with a force F. As a result, the first prong 51 moves away from the first tube portion 22A to establish a second gap G3 that is greater than the first gap G2. The spring 50 also moves away from the first tube portion 22A and toward the second tube portion 22B. The spring 50 however remains nonslidably attached or fixed or nonmoving relative to the hinge pin 40, via the nesting or interlocking of the transverse spring portion 55 in the groove 45 of the hinge pin 40. The hinge pin 40 and spring 50 move together, generally as a unit in the direction R1. The hinge pin 40 is effectively pulled along with the spring 50 under the force F. The first end 41 of the hinge pin 40 becomes removed from the first hole 101 of the firearm. Optionally, the secondary pin 30 remains in the second hole 102 of the firearm. The gap G1 also decreases in size or length when the second end 42 of the hinge pin moves toward the secondary pin 30.

While the force F is applied, the hinge pin and spring move in direction R1, the first prong 51 also engages the protrusion 25 which remains stationary relative to the panel 20. As result, the first prong 51 bends toward the hinge pin in direction L2. Generally, the first prong 51 also bends toward the coils 50C and the remainder of the spring 50. In so doing, the first prong 51 can be reoriented from a generally perpendicular configuration relative to the spring and/or spring axis SA to the offset angle A2 mentioned above.

Figure 4:
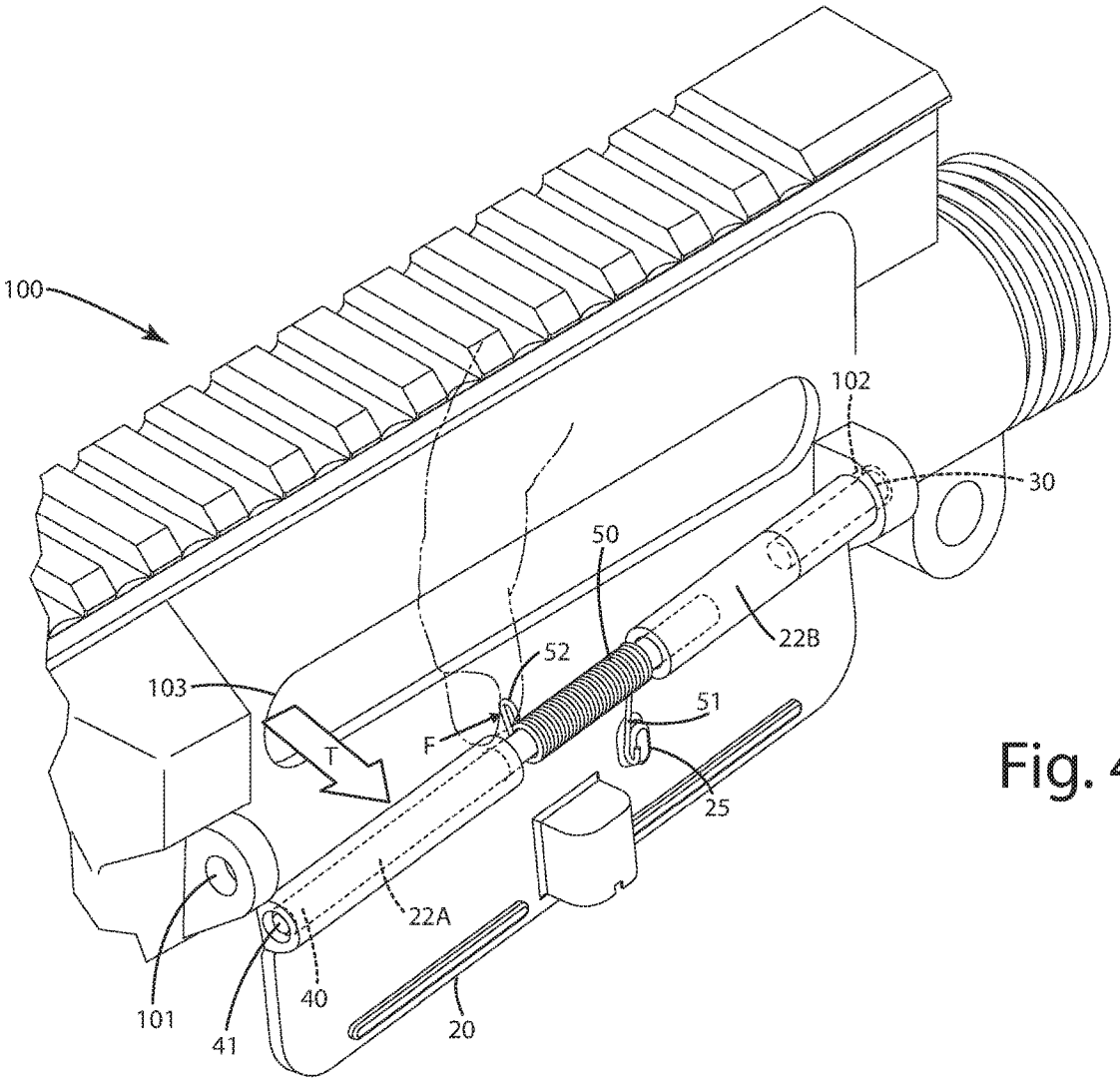
FIG. 4 is a perspective view of the dust cover being tilted away from the firearm to remove the dust cover therefrom.

With the hinge pin end 41 removed from the first hole 41, a user can tilt rotate, or otherwise move the dust cover 10 in direction T as shown in FIG. 4. In so doing, the hinge pin 40 is no longer aligned with or positioned in the first hole 101. The secondary pin 30, however, may remain disposed at least partially in or otherwise engaged with the firearm. While the user does this, the user can maintain the force F pushing on the second prong 52 so that the hinge pin 40 remains retracted in the passageway and/or the first tube portion 22A.

Figure 5:
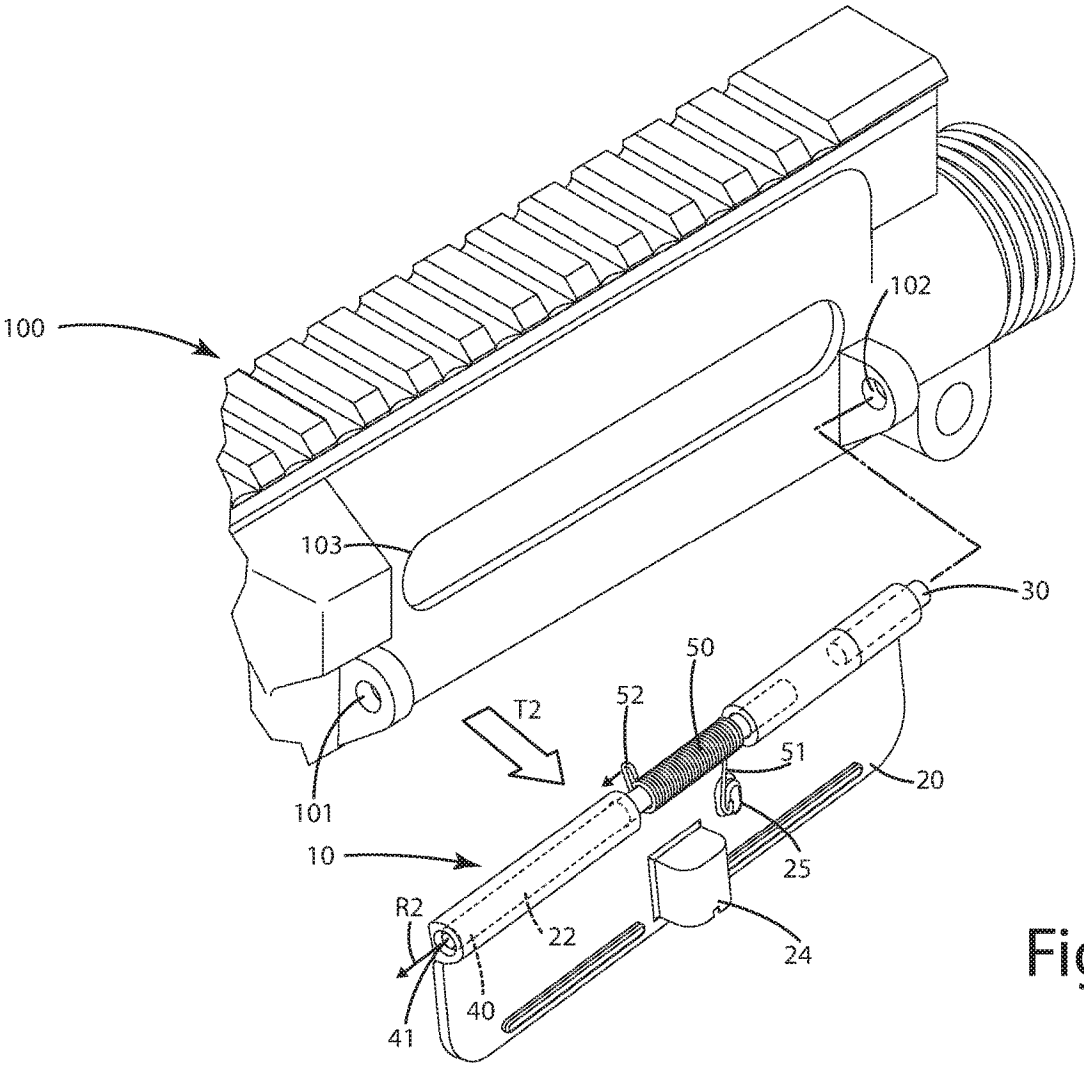
FIG. 5 is a perspective view of the dust cover being fully removed from the firearm.

When the end 41 is removed from the first hole 101, the hinge pin and panel are freed so they can be removed from the firearm. The user can move the dust cover 10 in the direction T2 and withdraw the secondary pin 30 from the second hole 102 of the firearm 100 as shown in FIG. 5. After the dust cover 10 is removed, the second prong 52 can be released so the force F is no longer applied, in which case, the hinge pin 40 is biased in direction R2 to extend. Thus, the end 41 extends outward from the passageway 22 again. This movement is provided by the energy stored in the first prong 51 engaging the protrusion 25 and the spring portion 55 pushing on the groove 45 of the hinge pin 40. As a result, the dust cover thereafter attains a state where the first end 41 of the hinge pin 40 extends from one end of the panel 20 and the secondary pin 30 continues to extend from the opposite end of the panel.

To reinstall the dust cover 10 relative to the firearm 100 and the respective first 101 and second 102 holes, the user can again actuate the spring 50 and move the hinge pin 40 so as to retract the end 41 into the passageway 22 by exerting a force F against the second prong 52. Thereafter, the user can insert secondary pin 30 into the second hole 102, then tilt the dust cover 10 to align the hinge pin 40 along the common axis CA. From there, the user can release the second prong 52 so that the first end 41 moves in direction R2 to install the hinge pin in the first hole and secure the dust cover 10 to the firearm 100.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A dust cover for a firearm, comprising:

a panel defining a passageway having a passageway axis, the panel configured to selectively cover an ejection port of a firearm;

a hinge pin extending within the passageway, the hinge pin defining a groove, the hinge pin including a first end, the first end configured to slidably engage a first hole defined by the firearm, the first hole aligned with a second hole along a common axis;

a torsion spring coiled around the hinge pin, the torsion spring including a first coil end and a distal second coil end, and a transverse spring portion adjacent the first coil end, the transverse spring portion disposed in the groove of the hinge pin so that the torsion spring is generally non-slidable relative to the hinge pin adjacent the transverse spring portion, wherein the torsion spring includes a first prong that extends away from the first coil end, the first prong configured to bias the panel away from the ejection port so that the panel rotates about the passageway axis, wherein the torsion spring includes a second prong that extends away from the second coil end, wherein the second prong is manually engageable by a user to slide the hinge pin within the passageway along the passageway axis while the torsion spring remains non-slidable relative to the hinge pin adjacent the transverse spring portion so as to remove the first end from the first hole and thereby free the hinge pin and panel for removal from the firearm.

2. The dust cover of claim 1, wherein the panel is pivotable about the hinge pin to pivot the panel from a first position that covers the ejection port of the firearm and a second position in which the ejection port is not covered.

3. The dust cover of claim 2, wherein the first prong and second prong extend into the ejection port when the panel is closed against the firearm such that the second prong cannot be manually engaged by the user when the panel is closed against the firearm, wherein the first prong extends away from the firearm when the panel is pivoted about the passageway axis to expose the ejection port of the firearm.

4. The dust cover of claim 1, wherein the first prong extends away from the first coil end a first distance, wherein the second prong extends away from the second coil end a second distance, wherein the first distance is greater than the second distance.

5. The dust cover of claim 4, wherein the first prong extends away from the first coil end at least ¼".

6. The dust cover of claim 1, wherein the first prong is configured to bend toward the hinge pin when the hinge pin slides within the passageway along the passageway axis while the torsion spring remains generally non-slidable relative to the hinge pin.

7. The dust cover of claim 1, wherein the hinge pin is cylindrical, wherein the groove is an annular groove extending around a circumference of the cylindrical hinge pin, wherein the transverse spring portion extends tangentially through a portion of the annular groove.

8. The dust cover of claim 1, wherein the first prong includes a first prong end that is bent in a first curved portion, wherein the second prong includes a second prong end that is bent in a second curved portion.

9. The dust cover of claim 1 comprising:

a secondary pin joined with the panel and extending along the common axis, wherein the hinge pin includes a second end distal from the first end, wherein the hinge pin second end is separated from the secondary pin by a gap, wherein the gap decreases when the hinge pin slides within the passageway.

10. The dust cover of claim 9, wherein the secondary pin is non-rotatable relative to the passageway and panel, wherein the hinge pin is rotatable relative to the passageway and panel.

11. The dust cover of claim 1, comprising:

a secondary pin immovably and fixedly joined with the panel, the secondary pin configured to rotatably mount in a second hole distal from the first hole of the firearm, wherein the hinge pin is separated from the secondary pin by a gap, wherein the gap decreases when the hinge pin slides within the passageway.

12. A dust cover for a firearm comprising:

a panel defining a passageway, the panel configured to selectively cover an ejection port of a firearm;

a hinge pin in the passageway;

a spring disposed around the hinge pin and including a spring portion that engages the hinge pin so that the spring is generally non-slidable relative to the hinge pin adjacent the spring portion, wherein the spring includes an outwardly extending first prong that engages the panel to bias the panel away from the ejection port, wherein the spring includes an outwardly extending second prong distal from the first prong, the second prong being manually engageable by a user to slide the hinge pin within the passageway while the spring is non-slidable relative to the hinge pin adjacent the spring portion so as to remove a part of the hinge pin from a first hole defined by the firearm and thereby free the hinge pin and panel for removal from the firearm.

13. The dust cover of claim 12, wherein the panel includes a protrusion on an interior surface of the panel, wherein the spring portion engages the protrusion when the hinge pin slides within the passageway so that the spring portion bends toward the hinge pin.

14. The dust cover of claim 12, wherein the passageway is formed by a tube having a first tube portion and a second tube portion, wherein the second prong is configured to move away from the first tube portion and toward the second tube portion when the hinge pin slides in the passageway.

15. The dust cover of claim 12, wherein the hinge pin is cylindrical, wherein hinge pin defines an annular groove extending around a circumference of the hinge pin, wherein the spring portion extends tangentially through a portion of the annular groove.

16. The dust cover of claim 12 comprising:

a secondary pin immovably and fixedly joined with the panel, the secondary pin configured to rotatably mount in a second hole distal from the first hole of the firearm;

wherein the hinge pin is separated from the secondary pin by a gap, wherein the gap decreases when the hinge pin slides within the passageway.

17. The dust cover of claim 12, wherein the first prong extends away from spring at least ¼", wherein the first prong is configured to bend toward the hinge pin when the hinge pin slides within the passageway while the spring remains generally non-slidable relative to the hinge pin.

18. A method of removing a dust cover from a firearm, the method comprising:

moving a dust cover relative to a firearm so that an ejection port is open, the dust cover including a panel defining a passageway, a hinge pin in the passageway, a spring disposed around the hinge pin and including a spring portion that engages the hinge pin, the spring including an outwardly extending first prong that engages the panel to bias the panel away from the ejection port, the spring including an outwardly extending second prong distal from the first prong; and engaging the second prong to slide the hinge pin within the passageway while the spring remains non-slidable relative to the hinge pin adjacent the spring portion so as to remove a part of the hinge pin from a first hole defined by the firearm and thereby free the hinge pin and panel for removal from the firearm.

19. The method of claim 18 comprising:

bending the first prong toward the hinge pin when the hinge pin slides within the passageway.

20. The method of claim 18 comprising:

maintaining a secondary pin fixedly joined with the panel, the secondary pin configured to rotatably mount in a second hole distal from the first hole of the firearm;

wherein the hinge pin is separated from the secondary pin by a gap, wherein the gap decreases when the hinge pin slides within the passageway.

* * * * *